US010124973B2

(12) United States Patent
Hari

(10) Patent No.: US 10,124,973 B2
(45) Date of Patent: Nov. 13, 2018

(54) SHEET CONVEYING DEVICE AND IMAGE FORMING APPARATUS INCORPORATING THE SHEET CONVEYING DEVICE

(71) Applicant: Kenji Hari, Kanagawa (JP)

(72) Inventor: Kenji Hari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/818,689

(22) Filed: Nov. 20, 2017

(65) Prior Publication Data

US 2018/0148286 A1 May 31, 2018

(30) Foreign Application Priority Data

Nov. 29, 2016 (JP) ..... 2016-230918

(51) Int. Cl.
*B65H 5/38* (2006.01)
*B65H 5/06* (2006.01)

(52) U.S. Cl.
CPC ..... *B65H 5/38* (2013.01); *B65H 5/062* (2013.01); *B65H 2801/03* (2013.01)

(58) Field of Classification Search
CPC . B65H 5/36; B65H 5/38; B65H 5/062; B65H 29/125; B65H 29/52; B65H 2404/61; B65H 2404/611; B65H 2404/63; B65H 2404/65; B65H 2404/657
See application file for complete search history.

(56) References Cited

U.S. PATENT DOCUMENTS

2002/0141800 A1* 10/2002 Fuchi ..... B65H 3/44 399/388
2009/0166966 A1* 7/2009 Nishikata ..... B65H 5/062 271/272
2009/0324311 A1* 12/2009 Matsumoto ..... B65H 5/36 399/400
2013/0249161 A1* 9/2013 Uchino ..... B65H 3/0684 271/9.01
2013/0264769 A1* 10/2013 Sugizaki ..... B65H 5/00 271/264
2016/0214814 A1* 7/2016 Kawai ..... B65H 5/068

FOREIGN PATENT DOCUMENTS

JP 2008-107633 5/2008
JP 2008-162771 7/2008
JP 2009-057155 3/2009
JP 2010-254451 11/2010

* cited by examiner

*Primary Examiner* — David H Bollinger
(74) *Attorney, Agent, or Firm* — Duft & Bornsen, PC

(57) ABSTRACT

A sheet conveying device, which is included in an image forming apparatus, includes a first guide, a second guide, and a lever. The first guide is fixedly disposed to the sheet conveying device. The second guide is disposed opposite the first guide and defining a sheet conveyance passage with the first guide and is configured to rotate about a support shaft thereof operable to open and close the sheet conveyance passage. The lever is configured to rotate about a rotation shaft thereof operable to rotate the second guide. The second guide is configured to change from a closed state in which the sheet conveyance passage is closed to an open state in which the sheet conveyance passage is open, after an angle of rotation of the lever exceeds a threshold value.

18 Claims, 6 Drawing Sheets

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2016-230918, filed on Nov. 29, 2016, in the Japan Patent Office, the entire disclosure of which is hereby incorporated by reference herein.

BACKGROUND

Technical Field

This disclosure relates to a sheet conveying device that feeds a sheet such as a paper, and an image forming apparatus including the sheet conveying device. The image forming apparatus corresponds to, for example, a copier, printer, facsimile machine, and a multi-functional apparatus including at least two functions of the copier, printer, and facsimile machine.

Related Art

Known image forming apparatuses such as copiers and printers employ a sheet conveyance device in which a sheet conveyance passage through which a sheet is conveyed. The sheet conveyance passage is defined by two guide plates (a pair of guide members) disposed facing each other.

For example, a known sheet conveying device includes two guide plates, one of which is a movable guide member to rotate about a support shaft along with rotation of an operation lever. According to this configuration, when a sheet is jammed in the sheet conveyance passage defined by and provided between the two guide plates, the jammed sheet can be removed successfully. To be more specific, as the operation lever rotates, the movable guide plate rotates. By so doing, a space is generated relative to the other guide plate, which is a fixed guide member, and therefore the jammed sheet can be removed via the space. In other words, a user can put the hand in the space to remove the jammed sheet.

SUMMARY

At least one aspect of this disclosure provides a sheet conveying device including a first guide, a second guide and a lever. The first guide is fixedly disposed to the sheet conveying device. The second guide is disposed opposite the first guide and defining a sheet conveyance passage with the first guide and configured to rotate about a support shaft thereof operable to open and close the sheet conveyance passage. The lever is configured to rotate about a rotation shaft thereof operable to rotate the second guide. The second guide is configured to change from a closed state in which the sheet conveyance passage is closed, to an open state in which the sheet conveyance passage is open, after an angle of rotation of the lever exceeds a threshold value.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
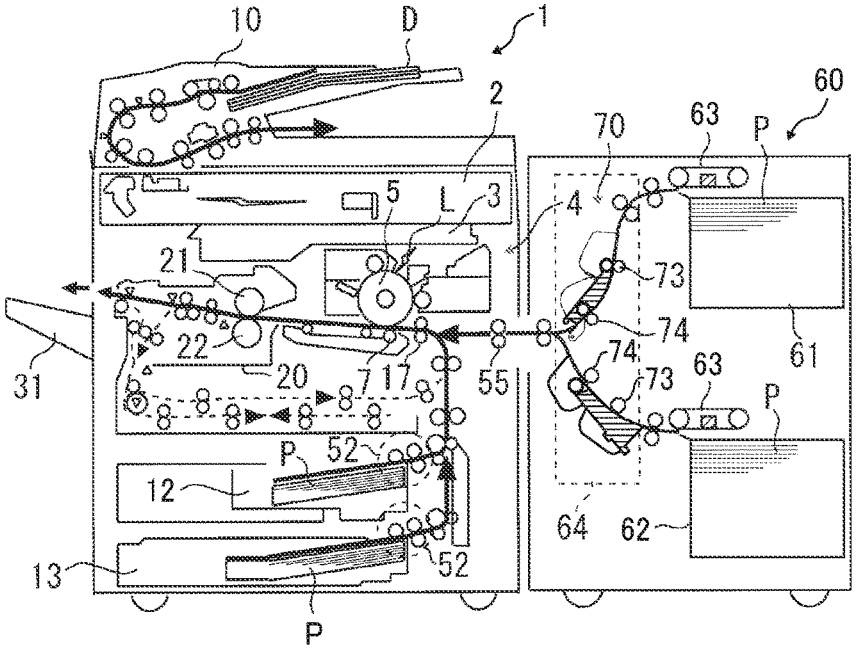
FIG. 1 is a diagram illustrating an overall configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus 1 according to an embodiment of this disclosure, with reference to drawings.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a sheet travels from an upstream side of a sheet conveying path to a downstream side thereof; the term "width direction" indicates a direction basically perpendicular to the sheet conveying direction.

Now, a description is given of a basic configuration and functions of the image forming apparatus 1 with reference to FIG. 1.

In FIG. 1, the image forming apparatus 1 includes a document reading device 2, an exposure device 3, an image forming device 4, a photoconductor drum 5, a transfer roller 7, a document conveying unit 10, a first sheet feed tray 12, a second sheet feed tray 13, a pair of registration rollers 17, a fixing device 20, a fixing roller 21, a pressure roller 22, a sheet output tray 31, and a sheet feeding device 60.

The document reading device 2 optically reads image data of an original document D.

The exposure device 3 emits an exposure light L based on the image data read by the document reading device 2 to irradiate the exposure light L on a surface of the photoconductor drum 5 that functions as an image bearer.

The image forming device 4 forms a toner image on the surface of the photoconductor drum 5.

The photoconductor drum 5 that functions as an image bearer and the transfer roller 7 that functions as a transfer body are included in the image forming device 4.

The transfer roller 7 transfers the toner image formed on the surface of the photoconductor drum 5 onto a sheet P.

The document conveying unit 10 functions as a document feeder that conveys the original document D set on a document tray or a document loader to the document reading device 2.

Each of the first sheet feed tray 12 and the second sheet feed tray 13 contains the sheet P such as a transfer sheet therein.

The pair of registration rollers 17 functions as a pair of timing rollers that conveys the sheet SP toward the transfer roller 7.

The fixing device 20 includes the fixing roller 21 and the pressure roller 22 to fuse an unfixed image formed on the sheet P to the sheet P by application of heat and pressure.

The sheet output tray 31 receives the sheet output from an apparatus body of the image forming apparatus 1.

The sheet feeding device 60 is a large capacity sheet feeder that contains a large number of sheets P therein.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals.

The converted electrical signals are transmitted to the exposure device 3 by which the image is optically written. Then, the exposure device 3 emits exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes, e.g., a charging process, an exposing process, and a developing process is completed, a toner image corresponding to the image data is formed on the surface of the photoconductor drum 5.

Thereafter, the toner image formed on the surface of the photoconductor drum 5 is transferred by the transfer roller 7, at a transfer nip region in the image forming device 4 where the transfer roller 7 and the photoconductor drum 5 contact to each other, onto the sheet P conveyed by the pair of registration rollers 17.

By contrast, the sheet P that is conveyed to the transfer roller 7 is handled as described below.

As illustrated in FIG. 1, one of the first sheet feed tray 12 and the second sheet feed tray 13 of the image forming apparatus 1 is selected automatically or manually. In the operations according to the present embodiment of this disclosure, the first sheet feed tray 12 that is an uppermost sheet tray is selected, for example. It is to be noted that the first sheet feed tray 12 and the second sheet feed tray 13 basically have an identical configuration to each other. Consequently, when the first sheet feed tray 12 of the image forming apparatus 1 is selected, an uppermost sheet P contained in the first sheet feed tray 12 is fed by a sheet feeding mechanism 52 toward a sheet conveyance passage. The sheet feeding mechanism 52 includes a sheet feed roller, a pickup roller, a backup roller, and so forth. Thereafter, the sheet P passes through the sheet conveyance passage in which multiple sheet conveying rollers are disposed, and reaches the pair of registration rollers 17.

It is to be noted that, when the sheet feeding device 60 that contains a large capacity of sheets (that is, a large capacity sheet feeder) disposed at one side of the apparatus body of the image forming apparatus 1 is selected, an uppermost sheet P placed on top of a sheet bundle SB loaded on one of two sheet trays 61 and 62 of the sheet feeding device 60 is fed by a conveying belt 63 into the sheet conveyance passage where pairs of sheet conveying rollers 73 and 74 are disposed. Then, the uppermost sheet P is conveyed by a pair of inlet rollers 55 included in the apparatus body of the image forming apparatus 1 into the apparatus body of the image forming apparatus 1, eventually reaching the pair of registration rollers 17.

After reaching the pair of registration rollers 17, the uppermost sheet P is then conveyed toward the transfer roller 7 in synchronization with movement of the toner image formed on the surface of the photoconductor drum 5 for positioning.

After completion of a transfer process, the sheet P passes the transfer roller 7 and reaches the fixing device 20 via the sheet conveyance passage. In the fixing device 20, the sheet P is conveyed between the fixing roller 21 and the pressure roller 22, so that the toner image is fixed to the sheet P by application of heat applied by the fixing roller 21 and pressure applied by the fixing roller 21 and the pressure roller 22, which is a fixing process. The sheet P with the toner fixed thereto after the fixing process passes a fixing nip region formed between the fixing roller 21 and the pressure roller 22. Then, the sheet P is output from the image forming apparatus 1. After having been output from the image forming apparatus 1, the sheet P is stacked as an output image, on the sheet output tray 31.

Accordingly, a series of image forming processes is completed.

Next, a detailed description is given of a sheet conveying device 70 according to an embodiment of this disclosure.

As illustrated in FIG. 1, the sheet conveying device 70 according to the present embodiment is included in the sheet feeding device 60 that is a large capacity sheet feeder. The sheet conveying device 70 conveys a sheet P.

Figure 2:
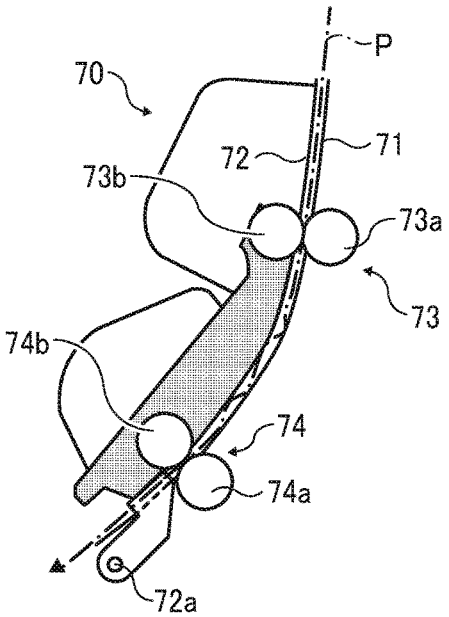
FIG. 2 is an enlarged view illustrating a sheet conveying device.

FIG. 2 is an enlarged view illustrating the sheet conveying device 70. In FIG. 2, the sheet P is conveyed from the sheet tray 61 to the sheet conveying device 70.

As illustrated in FIG. 2, the sheet conveying device 70 includes the pairs of sheet conveying rollers 73 and 74 disposed along the sheet conveyance passage indicated by a curved broken line. The pairs of sheet conveying rollers 73 and 74 includes drive rollers 73*a* and 74*a* and driven rollers 73*b* and 74*b*. The drive rollers 73*a* and 74*a* are rotated in a predetermined direction (i.e., a counterclockwise direction in FIG. 2). The driven rollers 73*b* and 74*b* are rotated in a clockwise direction in FIG. 2, along with rotations of the drive rollers 73*a* and 74*a* while contacting the drive rollers 73*a* and 74*a*, respectively. The pair of sheet conveying rollers 73 includes the drive roller 73*a* and the driven roller 73*b* and the pairs of sheet conveying rollers 74 includes the drive roller 74*a* and the driven roller 74*b*. With this configuration, the pairs of sheet conveying rollers 73 and 74 hold the sheet P therebetween and convey the sheet P in the sheet conveyance passage.

Referring to FIGS. 2 through 5, the sheet conveying device 70 includes a fixed guide 71 and an opening and closing guide 72.

Figure 3:
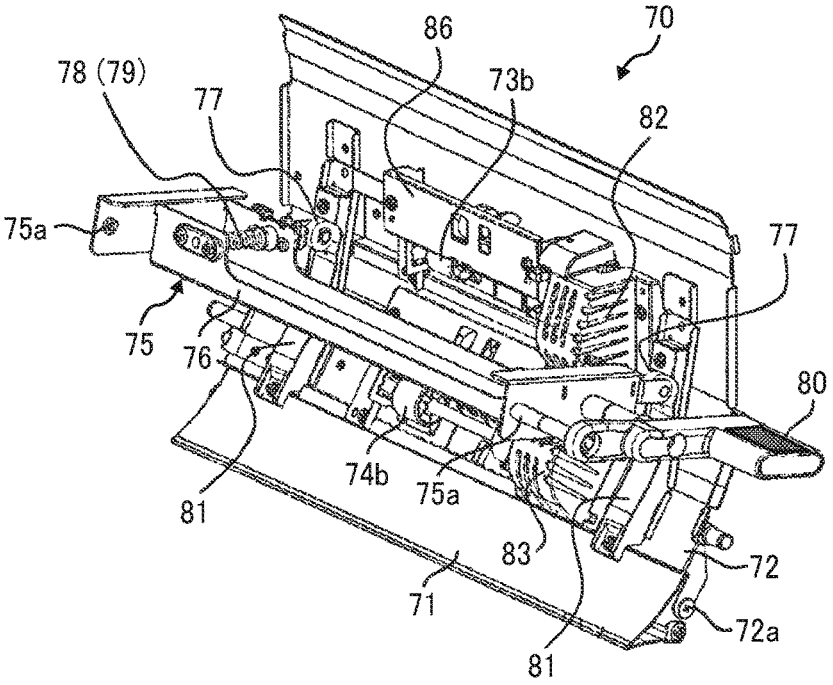
FIG. 3 is a perspective view illustrating the sheet conveying device of FIG. 2.
Figure 4:
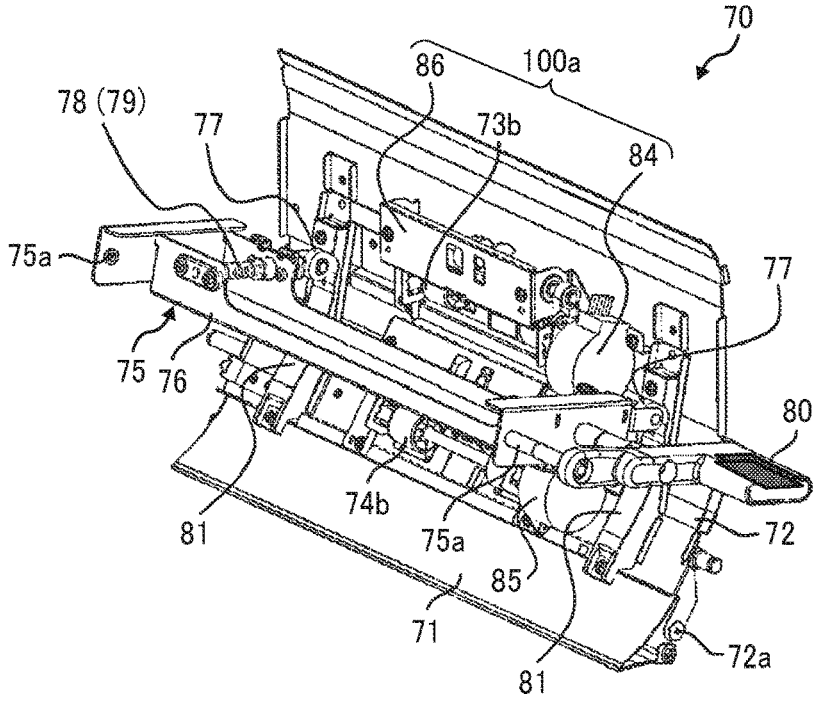
FIG. 4 is a perspective view illustrating the sheet conveying device in a state in which a motor cover is removed therefrom.
Figure 5:
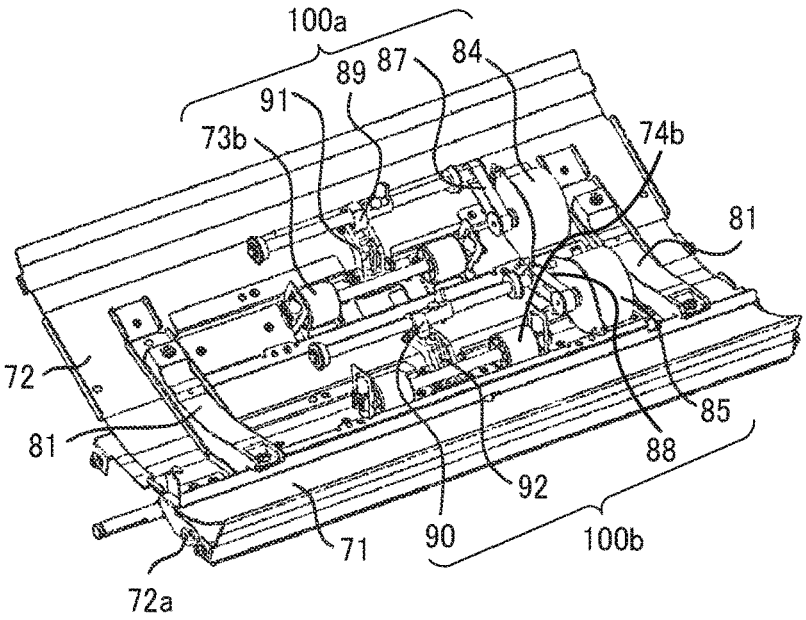
FIG. 5 is a perspective view illustrating the sheet conveying device including motor driving mechanisms to cause a pair of conveying rollers to contact and separate from each other.

FIG. 3 is a perspective view illustrating the sheet conveying device 70 of FIG. 2. FIG. 4 is a perspective view illustrating the sheet conveying device 70 in a state in which motor covers are removed therefrom. FIG. 5 is a perspective view illustrating the sheet conveying device 70 including motor driving mechanisms 100*a* and 100*b* to cause the driven rollers 73*b* and 74*b* of the pairs of sheet conveying rollers 73 and 74 to contact and separate from the drive rollers 73*a* and 74*a* of the pairs of sheet conveying rollers 73 and 74.

The fixed guide 71 is a plate-shaped member made of a metal material (or a resin material) and is fixedly disposed in a casing of the sheet conveying device 70. The drive rollers 73*a* and 74*a* are rotatably supported by the fixed guide 71.

The drive rollers 73*a* and 74*a* are provided such that part of each roller portion of the drive rollers 73*a* and 74*a* protrudes toward the sheet conveyance passage (i.e., toward the opening and closing guide 72) through an opening formed through the fixed guide 71.

The opening and closing guide 72 is a plate-shaped member made of a metal material (or a resin material). The opening and closing guide 72 is disposed facing the fixed guide 71 to define (and form) the sheet conveying passage in which the sheet P is conveyed. The driven rollers 73*b* and 74*b* are rotatably supported by the opening and closing guide 72.

The driven rollers 73*b* and 74*b* are provided such that part of the roller portion of the driven rollers 73*b* and 74*b* protrudes toward the sheet conveyance passage (i.e., toward the fixed guide 71) through an opening formed through the opening and closing guide 72.

The two guides, which are the fixed guide 71 and the opening and closing guide 72, are arranged to have a substantially constant opposing distance (that is, an optimized distance longer than the thickness of the sheet P) along the sheet conveyance passage. Further, in the sheet conveyance passage defined and formed by the fixed guide 71 and the opening and closing guide 72, the sheet P is guided by the fixed guide 71 and the opening and closing guide 72 and is held and conveyed by the pairs of sheet conveying rollers 73 and 74 in a direction indicated by arrow in FIG. 2.

In the present embodiment of this disclosure, the sheet conveyance passage is formed by the fixed guide 71 and the opening and closing guide 72 to be curved in a recessed shape toward the opening and closing guide 72.

Figure 6:
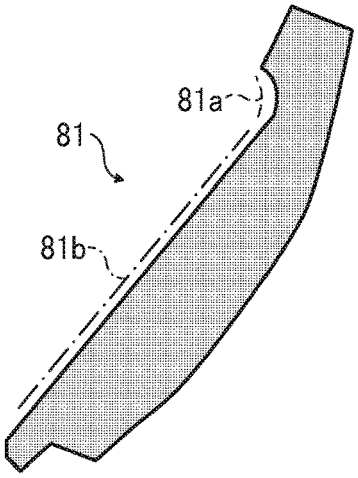
FIG. 6 is a side view illustrating a contact member.
Figure 7A:
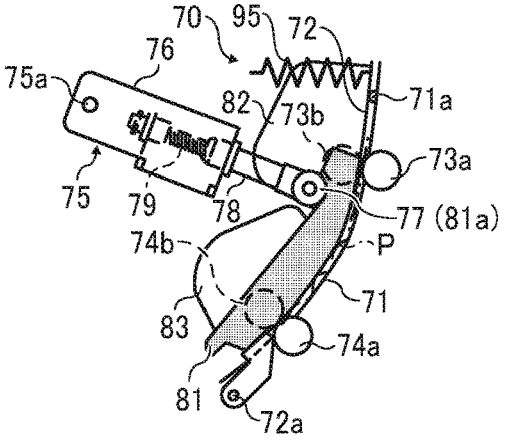
FIGS. 7A, 7B, 7C, 7D and 7E are diagrams illustrating motions of an opening and closing guide moving together with rotation of an operation lever.
Figure 7B:
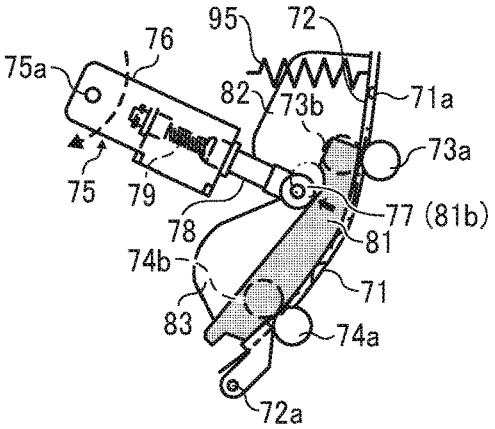
Figure 7C:
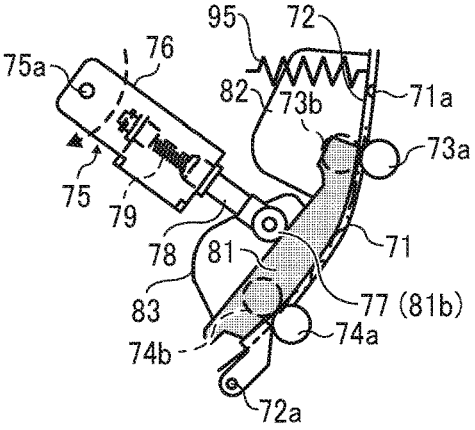

FIG. 6 is a side view illustrating contact members 81. FIGS. 7A, 7B and 7C are diagrams illustrating motions of the opening and closing guide 72 moving together with rotation of an operation lever 75.

The opening and closing guide 72 is retained in the casing of the sheet conveying device 70 to be rotatable about the support shaft 72*a* such that the sheet conveyance passage formed with respect to the fixed guide 71 is opened and closed. The sheet conveying device 70 includes the operation lever 75 (see FIGS. 3 and 7A through 7E). The operation lever 75 is rotated about a rotary shaft 75*a* so as to perform opening and closing of the opening and closing guide 72.

In the regular image forming operations, the opening and closing guide 72 is in a "closed state" where the sheet conveyance passage is closed. Specifically, the opening and closing guide 72 is in a state of FIGS. 2, 3, and 7A where the sheet conveyance passage is formed with respect to the fixed guide 71.

Figure 7D:
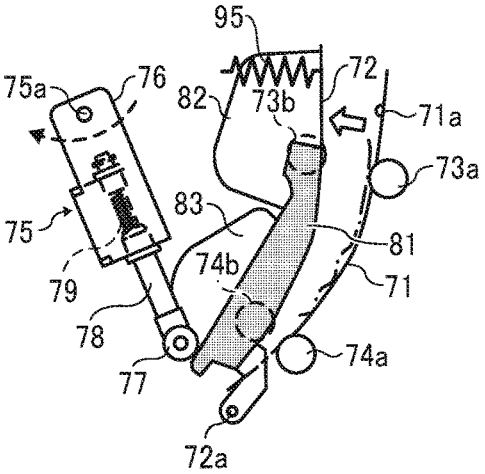
Figure 7E:
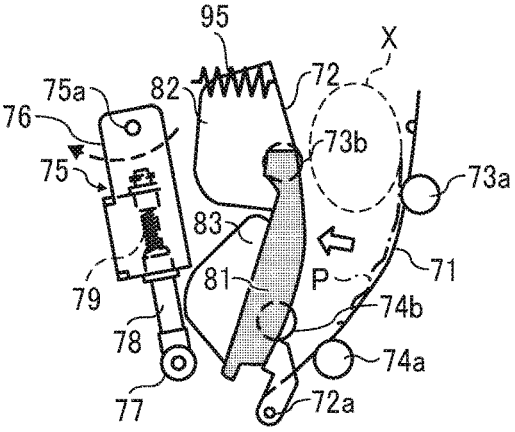

Further, in a case in which a sheet P is jammed in the sheet conveyance passage, the opening and closing guide 72 is rotated about the support shaft 72*a* in the counterclockwise direction of FIG. 2 along with rotation of the operation lever 75 to become an "open state". The open state of the opening and closing guide 72 is the state where the sheet conveyance passage is opened. As illustrated in FIG. 7E, no sheet conveyance passage is formed with respect to the fixed guide 71 and a large gap X (space) is formed.

Specifically, when the sheet P is jammed (i.e., when a paper jam occurs) in the sheet conveying passage of the sheet conveying device 70, this state is detected by a sheet detection sensor (a photosensor) disposed in the sheet conveyance passage. Then, the information is indicated on an indication panel (provided to the exterior portion of the image forming apparatus 1). Further, in order to remove the jammed sheet P from the sheet conveyance passage, a door 64 (see FIG. 1) of the sheet feeding device 60 (i.e., the large capacity sheet feeder) is opened to expose the sheet conveyance passage of the sheet conveying device 70. Then, a handle 80 (see FIG. 3) of the operation lever 75 is grasped to rotate the operation lever 75 in the clockwise direction in FIGS. 7A to 7E. When the opening and closing guide 72 is changed to the open state, the jammed sheet P is removed via the gap X formed therein. After the sheet P (that is, the jammed sheet) is removed, the handle 80 of the operation lever 75 is grasped to rotate the operation lever 75 in the counterclockwise direction of FIGS. 7A to 7E. The opening and closing guide 72 is changed into the closed state, and further closes the door 64. Thus, a series of jam processing operations is completed.

The sheet conveying device 70 of the present embodiment of this disclosure is provided such that, after the angle of rotation of the operation lever 75 of the operation lever 75 exceeds a predetermined value (i.e., a threshold value that is about 45 degrees in the present embodiment of this disclosure) from the start of rotation of the operation lever 75, the opening and closing guide 72 in the closed state is changed to the open state.

Specifically, when the opening and closing guide 72 in the closed state is opened, the operation lever 75 located at a home position thereof illustrated in FIG. 7A is rotated in the clockwise direction of FIG. 7A. However, for a short period of time after the operation lever 75 starts rotating from the home position illustrated in FIG. 7A, even when the operation lever 75 is rotated, the opening and closing guide 72 remains in the closed state. After the operation lever 75 is rotated by a certain angle, the opening and closing guide 72 in the closed state is changed to the open state, as illustrated in FIGS. 7D and 7E.

In other words, after the start of rotation of the operation lever 75, the opening and closing guide 72 in the closed state is rotated in the counterclockwise direction of FIGS. 7A through 7E at a different timing from the rotation of the operation lever 75.

More specifically, the operation lever 75 is supported by the casing of the sheet conveying device 70 to be rotatable about the rotary shaft 75*a*. The operation lever 75 is provided at an inner side of the opening and closing guide 72 (i.e., a side facing the opposite surface relative to a sheet conveying guide surface).

As illustrated in FIGS. 3 and 4, the operation lever 75 includes a lever body 76, rollers 77, shafts 78, compression springs 79 that functions as biasing members, and the handle 80. As illustrated in FIGS. 7A through 7E, when viewed in cross-section in a direction perpendicular to the rotary shaft 75*a*, the operation lever 75 is formed to radially extend toward the opening and closing guide 72 from the rotary shaft 75*a*.

The lever body 76 is made of a combination of metal plates and serves as a casing of the operation lever 75.

The rollers 77 are rotatably supported by the lever body 76 at a distal end of the operation lever 75, that is, a position distant from the rotary shaft 75*a* of the operation lever 75. Specifically, in the present embodiment, the two rollers 77 are disposed at both ends in the width direction of the sheet P (i.e., in a direction perpendicular to the sheet conveying direction of the sheet P, in other words, in a direction perpendicular to the drawing sheet of FIG. 2). The rollers 77 are rotatably held at respective ends of the shafts 78. The shafts 78 are held by the lever body 76 in a radial direction of a circle about the rotary shaft 75*a*. The shafts 78 are radially biased by the respective compression springs 79 that function as biasing members. Each of the compression springs 79 has one end coupled to the lever body 76 and the other end coupled to the shaft 78. Consequently, the rollers 77 are biased by the compression springs 79 (the biasing members) in a direction to contact the respective contact members 81 (i.e., in a direction to move away from the rotary shaft 75*a*).

The handle 80 is mounted on one end of the lever body 76 in the width direction (i.e., on an operation side of FIG. 1 where the opening and closing door 64 is opened and closed). The handle 80 is rotatable about the rotary shaft 75*a* together with parts and components including the lever body 76, the rollers 77, the shafts 78, and the compression springs 79 as a single unit. The handle 80 is disposed at a protruding position at one end of the sheet conveying device 70 in the width direction so as to be rotated without interference with other parts and members of the sheet conveying device 70.

Further, by rotating the handle 80 about the rotary shaft 75*a* while the handle 80 having the above-described structure is held by a user, the operation lever 75 is rotated together with the handle 80.

As illustrated in FIGS. 3 through 7C, the opening and closing guide 72 includes the contact members 81, the driven rollers 73*b* and 74*b*, the motor driving mechanisms 100*a* and 100*b*, and motor covers 82 and 83.

The contact members 81 are disposed on an opposite surface to the sheet conveying guide surface of the opening and closing guide 72. The contact members 81 contact the corresponding rollers 77 of the operation lever 75 on the opposite surface of the opening and closing guide 72.

With reference to FIG. 6, each of the contact members 81 includes a recess 81*a* and a sliding portion 81*b* on a portion to which the corresponding roller 77 contacts.

The roller 77 of the operation lever 75 engages with the recess 81*a* of the contact member 81 to restrict rotation of the operation lever 75. In other words, as illustrated in FIG. 7A, a state in which the roller 77 engages with the recess 81*a* is the state where the opening and closing guide 72 is closed, i.e., the state where rotation of the operation lever 75 is stopped and held still at the position. The state where the roller 77 engages with the recess 81*a* is maintained by a biasing force applied by the compression spring 79. The operation lever 75 does not rotate itself unless a force against the biasing force is applied, and the state illustrated in FIG. 7A is maintained.

The recess 81*a* has an arched recess surface shape (i.e., an arch having a central angle of 180 degrees or less) to match the shape of the outer circumference of the roller 77 so that the roller 77 contacts to and separates from the recess 81*a*.

The sliding portion 81*b* of the contact member 81 is a portion on which the roller 77 continues to slide until the engagement of the roller 77 with the recess 81*a* is canceled against the biasing force of the compression spring 79 that functions as a biasing member and the angle of rotation reaches a predetermined value (e.g., approximately 45 degrees in the present embodiment of this disclosure) after the start of rotation of the operation lever 75. The state where the roller 77 slides on the sliding portion 81*b* as described above is the state where the contact member 81 is being pressed via the roller 77 by the biasing force applied by the compression spring 79 (the biasing member). Although the operation lever 75 is rotated, the opening and closing guide 72 is in the closed state. Further, when the angle of rotation of the operation lever 75 exceeds the above-described predetermined value and the roller 77 is separated from the sliding portion 81*b*, the contact member 81 is released from the biasing force applied by the compression spring 79 that presses the contact member 81 via the roller 77. Consequently, the opening and closing guide 72 is changed from the closed state to the open state by a biasing force applied by a tension spring 95 (i.e., a biasing unit) described below.

In the present embodiment, the sliding portion 81*b* has a planar surface. However, the sliding portion 81*b* is formed such that the distance from the rotary shaft 75*a* of the operation lever 75 does not largely vary from a starting end of the sliding portion 81*b* to a terminal end of the sliding portion 81*b*.

In addition, the terminal end of the sliding portion 81*b* generally lies in a position where an imaginary straight line connecting the support shaft 72*a* and the rotary shaft 75*a* intersects the contact surface of the contact member 81. In other words, when the roller 77 passes the position of the terminal end of the sliding portion 81*b*, the roller 77 biased by the compression spring 79 applies a force to the contact member 81 to cause the contact member 81 (and the opening and closing guide 72) to rotate in the counterclockwise direction about the support shaft 72*a*.

Referring to FIGS. 7A to 7E, the sheet conveying device 70 includes the tension spring 95. The tension spring 95 functions as a biasing member to bias the opening and closing guide 72 to rotate to the open state.

Specifically, the tension spring 95 that functions as a biasing member has a hook at one end to be coupled to the opening and closing guide 72 at a portion sufficiently separated from the support shaft 72*a* and another hook at the other end to be coupled to the casing of the sheet conveying device 70.

Accordingly, as illustrated in FIGS. 7A to 7C, while the contact member 81 (and the opening and closing guide 72) is being pressed toward the fixed guide 71 via the roller 77 by the biasing force applied by the compression spring 79, the pressing force is applied against the biasing force of the tension spring 95, and as a result, the opening and closing guide 72 is closed. By contrast, as illustrated in FIGS. 7D and 7E, when the pressing of the contact member 81 (and the opening and closing guide 72) toward the fixed guide 71 via the roller 77 by the biasing force applied by the compression spring 79 is canceled, the opening and closing guide 72 is opened by the biasing force of the tension spring 95.

In addition, referring to FIGS. 7A to 7E, the sheet conveying device 70 includes a stopper 71*a* to restrict an opposing distance between the opening and closing guide 72 and the fixed guide 71 to a predetermined distance in a state in which the sheet conveyance passage is closed, as illustrated in FIG. 7A.

Specifically, the fixed guide 71 includes the stopper 71*a* projecting toward the opening and closing guide 72, at a position at an end of the fixed guide 71 in the width direction, so as not to interfere with the sheet P passing through the sheet conveyance passage.

Accordingly, as illustrated in FIGS. 7A to 7C, while the contact member 81 (and the opening and closing guide 72) is being pressed toward the fixed guide 71 via the roller 77 by the biasing force of the compression spring 79, the biasing action is restricted in a state in which the opening and closing guide 72 is in contact with the stopper 71*a* of the fixed guide 71. Therefore, the opening and closing guide 72 is closed while the opposing distance between the fixed guide 71 and the opening and closing guide 72 is optimized.

It is to be noted that, in the present embodiment, the contact member 81 is made of a resin material as a component different from the opening and closing guide 72 that is made of a metal material. The contact member 81 is fixedly disposed on the opening and closing guide 72 by screw fastening.

By contrast, the contact member 81 may be formed with the opening and closing guide 72 as a single unit. For example, the opening and closing guide 72 and the contact member 81 may be formed of a resin material into a single unit by injection molding. With this configuration, the number of components of the sheet conveying device 70 is reduced.

Next, a description is given of operations of the opening and closing guide 72 in the closed state to be changed to the open state, with reference to FIGS. 7A to 7E.

The opening and closing guide 72 is opened when the operation lever 75 is moved in the order of FIGS. 7A to 7E.

First, when a force is applied in the direction of rotation of the operation lever 75 from a supported state illustrated in FIG. 7A (i.e., a state in which the roller 77 is engaged with the recess 81*a*), the operation lever 75 moves over the recess

81*a* in a direction indicated by black arrow (i.e., in a direction to approach the rotary shaft 75*a*) against the biasing force of the compression spring 79 as illustrated in FIG. 7B. When the operation lever 75 moves over (or moves into) the recess 81*a* against the biasing force of the compression spring 79, a user or an operator hears or feels a click feeling. Accordingly, the operability of the operation lever 75 during an engagement canceling motion (or an engaging motion) between the recess 81*a* and the roller 77 is enhanced.

Then, as the operation lever 75 in the clockwise direction is further rotated, the roller 77 slides on the surface of the sliding portion 81*b*, as illustrated in FIG. 7C. In the above-described state, the contact member 81 is being pressed by the biasing force applied by the compression spring 79 via the roller 77. Therefore, the opening and closing guide 72 is closed although the operation lever 75 is rotated.

Further, as the operation lever 75 is further rotated in the clockwise direction, the roller 77 passes by the position of the sliding portion 81*b* and reaches the position of the projection of the contact member 81, as illustrated in FIG. 7D. Upon arrival of the operation lever 75 to the projection of the contact member 81, the state in which the contact member 81 is pressed by the biasing force of the compression spring 79 via the roller 77 is canceled, so that the opening and closing guide 72 starts rotating in the counterclockwise direction about the support shaft 72*a* by the biasing force of the tension spring 95 (a biasing member).

Further, as the operation lever 75 is further rotated in the clockwise direction, the roller 77 becomes completely separated from the contact member 81, in other words, does not contact the contact member 81 at all, as illustrated in FIG. 7E. Then, the opening and closing guide 72 is further rotated in the counterclockwise direction about the support shaft 72*a* by the biasing force of the tension spring 95. Accordingly, the rotation of the operation lever 75 is stopped (confined) at a position where the operation lever 75 contacts a receiving portion formed on the casing of the sheet conveying device 70. In this state, as illustrated in FIG. 7E, the gap X formed between the opening and closing guide 72 in the open state and the fixed guide 71 is substantially large. By contrast, the operation lever 75 is also restrained from rotating in the clockwise direction about the rotary shaft 75*a* at the position at which the operation lever 75 contact the receiving portion formed on the casing of the sheet conveying device 70. Accordingly, the operation of the opening and closing guide 72 in the closed state to become the open state is completed. Therefore, a sheet P jammed in the sheet conveyance passage is removed by a user by inserting the hand through the large gap X formed as illustrated in FIG. 7E.

It is to be noted that, regarding the operation of the opening and closing guide 72 to change from the open state as illustrated in FIG. 7E to the closed state as illustrated in FIG. 7A, the same operation is performed as the above-described steps in reverse order.

In the present embodiment, the opening and closing guide 72 includes the motor driving mechanisms 100*a* and 100*b*. The motor driving mechanisms 100*a* and 100*b* cause the driven rollers 73*b* and 74*b* to move at a predetermined time in a direction to move away from the drive rollers 73*a* and 74*a* provided to the fixed guide 71. Two motor driving mechanisms 100*a* and 100*b* in the present embodiment are provided corresponding to the two driven rollers 73*b* and 74*b*. Specifically, referring to FIGS. 3 to 5, the motor driving mechanism 100*a* includes a motor 84, a bracket 86, a timing belt 87, a cam 89 and a swing lever 91 and the motor driving mechanism 100*b* includes a motor 85, a timing belt 88, a cam 90, and a swing levers 92. In addition, the opening and closing guide 72 includes the motor covers 82 and 83 for covering the motors 84 and 85, respectively.

In the present embodiment, in the image forming operation, when the lateral displacement of the sheet P in the width direction is corrected (positional error correction) with a pair of movable rollers (that is, a pair of sheet conveying rollers, e.g., the pair of registration rollers 17, that is movable in the width direction while holding the sheet P) provided at a position upstream from the sheet conveying device 70 in the sheet conveying direction, the driven rollers 73*b* and 74*b* are to be separated from the drive rollers 73*a* and 74*a* by the motor driving mechanisms 100*a* and 100*b* such that the correction precision is not degraded due to a load on the sheet P as a trailing end of the sheet P to be corrected is held by the pair of sheet conveying rollers 73 and 74. Specifically, at such a time, the motors 84 and 85 are actuated and the driving force of the motors 84 and 85 is transmitted to the shaft on which the cams 89 and 90 are mounted via the timing belts 87 and 88, respectively. By so doing, the cams 89 and 90 are rotated to swing the swing levers 91 and 92, respectively, to move the driven rollers 73*b* and 74*b*, which are biased toward the drive rollers 73*a* and 74*a* via the bracket 86, in the direction against the biasing force.

Accordingly, in the sheet conveyance passage of the sheet conveying device 70, the driven roller 73*b* and 74*b* are separated from the drive rollers 73*a* and 74*a*, respectively.

As described above, the sheet conveying device 70 according to the present embodiment is configured such that, as the operation lever 75 at the home position starts rotating, the angle of rotation of the operation lever 75 exceeds the predetermined value. Thereafter, the opening and closing guide 72 in the closed state is changed to the open state. Accordingly, even in a relatively small space, the opening and closing guide 72 can be rotated over a relatively large range due to rotation of the operation lever 75. Therefore, the gap X (the space) formed between the opening and closing guide 72 in the open state and the fixed guide 71 is also increased, facilitating the operation of removal of the sheet P (a jammed paper) caught and jammed in the sheet conveyance passage.

In addition, after the start of rotation of the operation lever 75, the opening and closing guide 72 is rotated at a different timing. Therefore, the failure of generating faulty rotation due to interference of the opening and closing guide 72 with the operation lever 75 hardly occurs. In particular, in the present embodiment, as illustrated in FIG. 3, since the motor covers 82 and 83 are provided at a position relatively close to the operation lever 75, the rotation at a different timing increases the effect of avoiding the interference.

As described above, it is preferable that the angle of rotation of the operation lever 75 (i.e., the predetermined value) corresponding to the rotation position at which the opening and closing guide 72 is changed from the closed state to the open state is 30 degrees or greater. In a case in which the angle of rotation of the operation lever 75 (the predetermined value) is less than 30 degrees, the range of rotation of the opening and closing guide 72 is not increased sufficiently and the gap X for removing the sheet P (i.e., the jammed paper) cannot be ensured sufficiently.

In addition, it is preferable that the angle of rotation of the operation lever 75 (i.e., the predetermined value) is 90 degrees or smaller. In a case in which the angle of rotation of the operation lever 75 (the predetermined value) exceeds 90 degrees, the range of rotation of the operation lever 75 is excessively increased, and therefore it becomes difficult to operate the operation lever 75.

Figure 8:
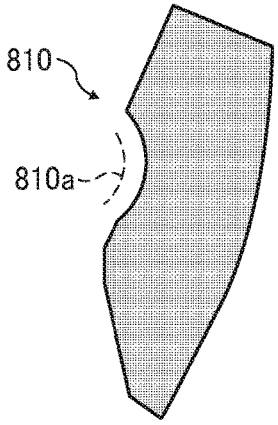
FIG. 8 is a schematic diagram illustrating a contact member provided to a comparative sheet conveying device.
Figure 9A:
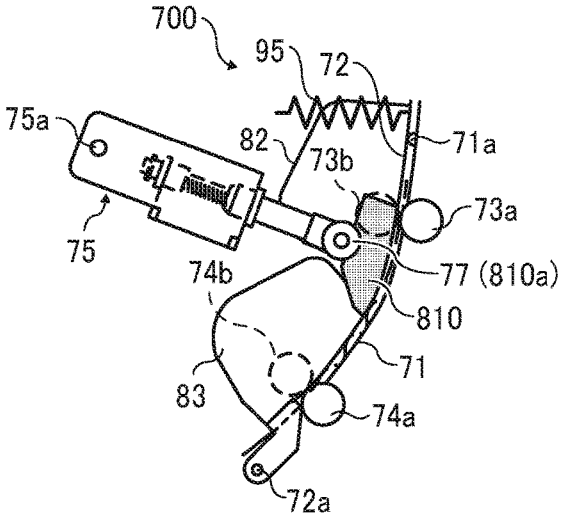
FIGS. 9A and 9B are diagrams illustrating motions of an opening and closing guide moving together with rotation of an operation lever in the comparative sheet conveying device.
Figure 9B:
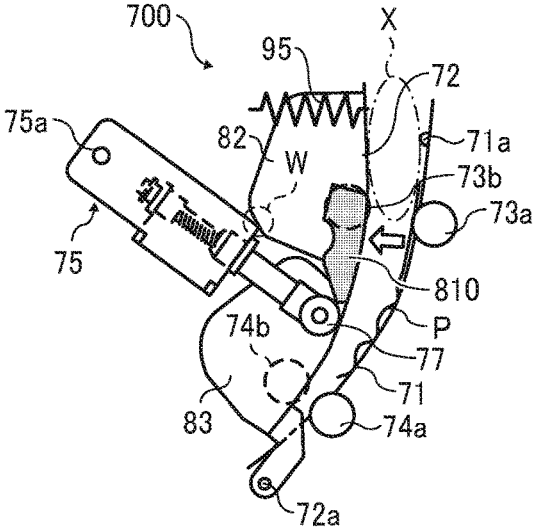

FIG. 8 is a schematic diagram illustrating a contact member 810 provided to a comparative sheet conveying device 700. FIGS. 9A and 9B are diagrams illustrating motions of an opening and closing guide moving together with rotation of the operation lever 75 in the comparative sheet conveying device 700.

Specifically, FIG. 8 is a side view illustrating the contact member 810 that is provided to make the angle of rotation of the operation lever 75 (the predetermined value) be set to zero (or a similar angle). In other words, the contact member 810 of FIG. 8 has a recess 810*a* with which the roller 77 of the operation lever 75 engages. However, different from the contact member 81 according to the present embodiment, the contact member 810 of the comparative sheet conveying device 700 does not have a sliding portion. Therefore, when the contact member 810 is employed, the opening and closing guide 72 in the closed state is changed to the open state immediately after the start of rotation of the operation lever 75 located at the home position, as illustrated in FIGS. 9A and 9B.

Consequently, the opening and closing guide 72 is rotated along with rotation of the operation lever 75 in a relatively small range. Due to this configuration, the gap X (the space) generated between the opening and closing guide 72 in the open state and the fixed guide 71 is also relatively small, and therefore removal of the sheet P (i.e., the jammed sheet) from the sheet conveyance passage becomes difficult.

In addition, the opening and closing guide 72 is rotated immediately after the start of rotation of the operation lever 75, the opening and closing guide 72 interferes with the operation lever 75, which easily results in faulty rotation. In particular, similar to the configuration of the present embodiment, in a case in which the motor covers 82 and 83 are provided at respective positions relatively closer to the operation lever 75, the motor cover 82 interferes with the operation lever 75 in the open state, as indicated in an area W circled by a broken line of FIG. 9B.

As described above, in the present embodiment of this disclosure, the opening and closing guide 72 is rotated at a different timing from the operation lever 75, that is, after the start of rotation of the operation lever 75. According to this operation, the above-described inconvenience or failure generated in the comparative sheet conveying device 700 can be restrained in the sheet conveying device 70 according to the present embodiment of this disclosure.

Variation.

Figure 10:
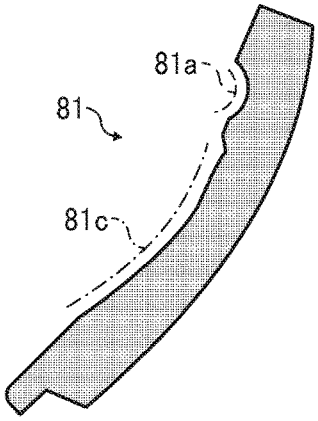
FIG. 10 is a side view illustrating the contact member as Variation of the embodiment of this disclosure.
Figure 11A:
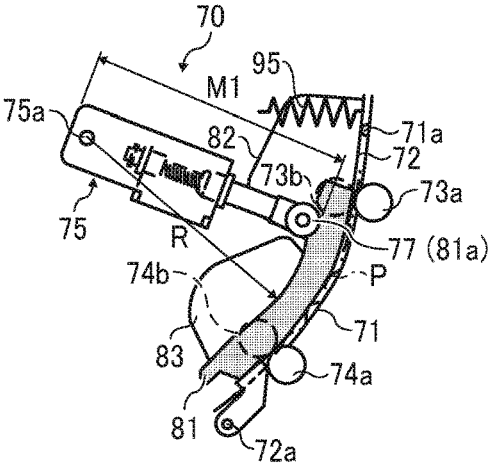
FIGS. 11A, 11B and 11C are diagrams illustrating motions of the opening and closing guide moving together with the operation lever according to Variation of the embodiment of this disclosure.
Figure 11B:
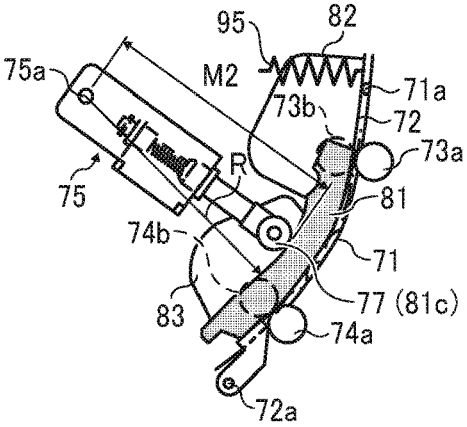
Figure 11C:
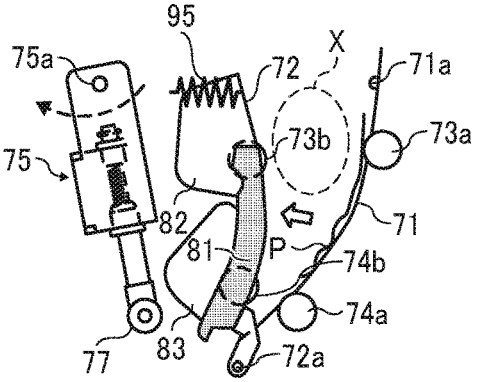

FIG. 10 is a side view illustrating the contact member 81 as Variation of the embodiment of this disclosure. FIG. 10 is a view corresponding to FIG. 6 of the present embodiment. In addition, FIGS. 11A, 11B and 11C are diagrams illustrating motions of the opening and closing guide 72 moving together with the operation lever 75 according to Variation of the embodiment of this disclosure. FIGS. 11A, 11B and 11C correspond to FIGS. 7A, 7B and 7C of the present embodiment, respectively.

As illustrated in FIGS. 10 and 11A through 11C, a sliding surface of a sliding portion 81*c* of the contact member 81 according to Variation is formed in a curved face arched in a downward projecting manner so that a distance R from the rotary shaft 75*a* of the operation lever 75 is constant.

With this configuration, when the roller 77 of the operation lever 75 engages with the recess 81*a* of the contact member 81, a distance from the rotary shaft 75*a* of the operation lever 75 to a contact point between the roller 77 and the recess 81*a* corresponds to a distance M1, as illustrated in FIG. 11A. Further, as the operation lever 75 starts rotating in the clockwise direction and the roller 77 moves over the recess 81*a*, the distance becomes temporarily shorter than the distance M1.

Then, when the roller 77 of the operation lever 75 slidably moves on the sliding portion 81*c* of the contact member 81, the distance from the rotary shaft 75*a* of the operation lever 75 to the contact point between the roller 77 and the recess 81*a* corresponds to a distance M2 constantly, as illustrated in FIG. 11B. Therefore, a variation in friction resistance generated when the roller 77 slides on the sliding portion 81*c* is reduced, and therefore the operation lever 75 can be rotated smoothly.

Consequently, as the operation lever 75 is further rotated, the roller 77 of the operation lever 75 is separated from the contact member 81, as illustrated in FIG. 11C. Then, similar to the present embodiment of this disclosure, the opening and closing guide 72 is opened with the large gap X with respect to the fixed guide 71.

As described above, the sheet conveying device 70 according to the present embodiment of this disclosure includes the fixed guide 71, the opening and closing guide 72 provided to be rotatable about the support shaft 72*a* to open and close the sheet conveyance passage, and the operation lever 75 that is rotated about the rotary shaft 75*a* to open or close the opening and closing guide 72. In addition, after the angle of rotation of the operation lever 75 exceeds the predetermined value from the start of rotation of the operation lever 75, the opening and closing guide 72 in the closed state is changed to the open state.

Accordingly, by rotating the operation lever 75, the opening and closing guide 72 can rotate relatively largely.

It is to be noted that the present embodiment of this disclosure is applied to the sheet conveying device 70 provided to the image forming apparatus 1 that performs monochrome image formation. However, this disclosure is not limited thereto. For example, this disclosure can also be applied to a sheet conveying device provided to an image forming apparatus that performs color image formation.

Further, it is to be noted that the present embodiment of this disclosure is applied to the sheet conveying device 70 provided to the image forming apparatus 1 that employs electrophotography. However, this disclosure is not limited thereto. For example, this disclosure can also be applied to a sheet conveying device provided to an image forming apparatus that employs an inkjet method or a stencil printing machine.

Further, it is to be noted that the present embodiment of this disclosure is applied to the sheet conveying device 70 that is provided to part of the sheet feeding device 60 (i.e., the large capacity sheet feeder) of the image forming apparatus 1. However, this disclosure is not limited thereto. For example, this disclosure can also be applied to a sheet conveying device as long as the guide is employed. In addition, for example, this disclosure can also be applied to a sheet conveying device as long as the document conveying unit 10 (the ADF) that functions as a sheet conveying device is employed.

Further, when the above-described sheet conveying devices such as the sheet conveying device 70 can achieve the same effect as the effect provided by the configuration(s) in the present embodiment.

It is to be noted that, as described above, a "sheet" is not limited to indicate a paper material but also includes other materials such as a plastic material (e.g., an OHP film sheet) and a fabric sheet. In addition, the "sheet" is not limited to a transfer sheet or recording medium to be printed but is applicable to an original document to be fed in a sheet feeding device such as an automatic document feeder.

Further, in this disclosure, the phrase "a state in which a roller slides or slidingly moves on a sliding contact portion" indicates that a roller slidingly moves on the surface of a sliding contact portion while rotating.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a first guide fixedly disposed thereto;

a second guide disposed opposite the first guide, the first guide and the second guide separated by a width of a sheet conveyance passage, the second guide configured to rotate about a support shaft thereof operable to open and close the sheet conveyance passage; and a lever configured to rotate about a rotation shaft thereof operable to rotate the second guide, the second guide configured to change from a closed state in which the sheet conveyance passage is closed, to an open state in which the sheet conveyance passage is open, after an angle of rotation of the lever exceeds a threshold value.

2. The sheet conveying device according to claim 1, wherein the threshold value is an angle of at least 30 degrees.

3. An image forming apparatus comprising the sheet conveying device according to claim 2.

4. The sheet conveying device according to claim 2, wherein the threshold value is an angle of 45 degrees.

5. An image forming apparatus comprising the sheet conveying device according to claim 4.

6. The sheet conveying device according to claim 1, wherein the lever includes a roller rotatably disposed at a position distant from a rotary shaft, wherein the second guide has a conveyance guide surface and includes a contact body disposed on an opposite surface to the conveyance guide surface, the contact body configured to contact the roller on the opposite surface, wherein the lever includes a biasing body configured to apply a biasing force and bias the roller toward a direction to which the roller contacts the contact body, and wherein the contact body includes:

a recess configured to cause the roller to contact thereon and restrain rotation of the lever; and a sliding portion on which the roller slides until the angle of rotation of the lever reaches the threshold value after a start of rotation of the lever based on a release of the roller from the recess against the biasing force applied by the biasing body.

7. The sheet conveying device according to claim 6, wherein the second guide is in the closed state during a period of time in which the roller contacts the recess while the rotation of the lever is being stopped and held, wherein the second guide is in the closed state during a period of time in which the roller slides on the sliding portion of the contact body while the lever is rotating, and wherein the second guide changes from the closed state to the open state based upon separation of the roller from the sliding portion of the contact body due to the angle of rotation of the lever exceeding the threshold value.

8. An image forming apparatus comprising the sheet conveying device according to claim 7.

9. The sheet conveying device according to claim 6, further comprising:

a second biasing body, different from the biasing body biasing the roller, configured to bias the second guide in a direction to open the second guide; and a stopper configured to restrict a distance between the first guide and the second guide to a predetermined distance while the sheet conveyance passage is closed.

10. An image forming apparatus comprising the sheet conveying device according to claim 9.

11. The sheet conveying device according to claim 6, wherein the sliding portion of the contact body includes a sliding surface having a curved face ached in a downwardly projecting manner operable to have a constant distance from the rotation shaft of the lever.

12. An image forming apparatus comprising the sheet conveying device according to claim 11.

13. The sheet conveying device according to claim 6, wherein the contact body is formed on the second guide as a single unit.

14. An image forming apparatus comprising the sheet conveying device according to claim 13.

15. An image forming apparatus comprising the sheet conveying device according to claim 6.

16. The sheet conveying device according to claim 1, wherein the first guide includes a drive roller configured to rotate in a predetermined direction, and wherein the second guide includes:

a driven roller configured to contact the drive roller and rotate along with rotation of the drive roller, the driven roller configured to form a pair of conveyance rollers with the drive roller and convey the sheet in the sheet conveyance passage; and a motor driver configured to cause the driven roller to separate at a predetermined time in a direction to separate from the drive roller.

17. An image forming apparatus comprising the sheet conveying device according to claim 16.

18. An image forming apparatus comprising the sheet conveying device according to claim 1.

* * * * *